US008235493B2

(12) United States Patent
Horade et al.

(10) Patent No.: US 8,235,493 B2
(45) Date of Patent: Aug. 7, 2012

(54) IMAGE RECORDING APPARATUS

(75) Inventors: Kenta Horade, Tokai (JP); Shunsuke Mizutani, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 170 days.

(21) Appl. No.: 12/857,355

(22) Filed: Aug. 16, 2010

(65) Prior Publication Data

US 2011/0069102 A1 Mar. 24, 2011

(30) Foreign Application Priority Data

Sep. 24, 2009 (JP) ..... 2009-219361

(51) Int. Cl.
*B41J 29/38* (2006.01)

(52) U.S. Cl. ..... 347/16

(58) Field of Classification Search ..... 347/16, 347/29, 30, 101, 104
See application file for complete search history.

(56) References Cited

U.S. PATENT DOCUMENTS

| | | | | |
|---|---|---|---|---|
| 5,488,463 | A * | 1/1996 | Nimura et al. | 399/381 |
| 7,607,845 | B2 * | 10/2009 | Mizutani | 400/624 |
| 2007/0048058 | A1 | 3/2007 | Koga et al. | |

FOREIGN PATENT DOCUMENTS

| | | | |
|---|---|---|---|
| JP | H08-118611 | A | 5/1996 |
| JP | H08-185092 | A | 7/1996 |
| JP | H09-295412 | A | 11/1997 |
| JP | 2007-022029 | A | 2/2007 |
| JP | 2007-090761 | A | 4/2007 |

* cited by examiner

*Primary Examiner* — An Do

(74) *Attorney, Agent, or Firm* — Baker Botts L.L.P.

(57) ABSTRACT

An image recording apparatus including: a sheet-feed mechanism; a sheet-detect portion; an image recording portion having a nozzle face; a cap for covering the nozzle face; a sucking mechanism; a drive source which generates a drive force; a drive-force transmitting mechanism which transmits one of a forward-direction drive force and a reverse-direction drive force to the sheet-feed mechanism and the sucking mechanism respectively for feeding of the sheet in one direction by the sheet-feed mechanism and an operation of the sucking mechanism, and which transmits the other thereof to the sheet-feed mechanism for feeding of the sheet in another direction by the sheet-feed mechanism; and a controller which controls the drive source such that the sheet is fed in the one direction and discharged without the feeding in said other direction by the sheet-feed mechanism after the sheet-detect portion has detected the sheet during the operation of the sucking mechanism.

13 Claims, 11 Drawing Sheets

IMAGE RECORDING APPARATUS

CROSS REFERENCE TO RELATED APPLICATION

The present application claims priority from Japanese Patent Application No. 2009-219361, which was filed on Sep. 24, 2009, the disclosure of which is herein incorporated by reference in its entirety.

BACKGROUND OF THE INVENTION

1. Field of the Invention

The present invention relates to an image recording apparatus configured to perform image recording by ejecting ink droplets from a recording head onto a sheet and, in particular, an image recording apparatus including a purging mechanism configured to suck and discharge ink from the recording head by a sucking pump.

2. Description of the Related Art

There is conventionally known an image recording apparatus configured to perform image recording on a sheet by ejecting ink on the basis of an input signal. The image recording apparatus of this type is generally referred to as an "ink-jet printer". Image recording of the ink-jet printer is performed by selectively ejecting the ink through ink-ejection openings of the recording head.

There may be caused a case where air bubbles are generated or foreign materials are clogged in ink channels respectively leading to the ink-ejection openings in the recording head. This may deteriorate an accuracy of the ejection of the ink droplets from the recording head. In order to prevent or recover this deterioration, there is known a technique for removing the air bubbles and the foreign materials from the ink-ejection openings of the recording head. This technique is generally referred to as "purging". The purging is performed by a maintenance unit. The maintenance unit includes a cap for covering the ink-ejection openings of the recording head, a pump configured to generate a sucking pressure in the cap covering the ink-ejection openings of the recording head, and so on. A motor is used as a drive source of the cap and the pump. In addition to the purging, the ink-jet printer is configured to perform flashing for removing the air bubbles and mixed ink in the recording head and to perform wiping for wiping ink adhering nozzles which are formed in the recording head and through which the ink droplets are ejected. These operations are collectively referred to as "cleaning".

Further, there is known an image recording apparatus including a drive-force-transmission changing mechanism configured to change a drive-force transmission from a motor to components to be driven. This drive-force-transmission changing mechanism is configured to transmit the drive force to one of the components to be driven, in accordance with a position of a carriage.

SUMMARY OF THE INVENTION

Considering a recent demand for a smaller ink-jet printer in size, it is preferable that the above-described drive-force-transmission changing mechanism has a simple structure. For example, the following structure can be employed. A common drive source is used to a maintenance unit and a sheet-feed roller. The drive force is transmitted to the maintenance unit where the carriage on which the recording head is mounted is located at a position facing the maintenance unit, i.e., a position at which the purging is performed, and is not transmitted to the maintenance unit where the carriage is located at a position at which the image recording is performed. The drive force is transmitted to the sheet-feed roller regardless of the position of the carriage. In the maintenance unit, when a forward rotational force is transmitted, the pump is driven, while when a reverse rotational force is transmitted, a communicating state and a disconnected state of the cap and the pump are changed or switched.

Where the drive-force-transmission changing mechanism of the ink-jet printer has this structure, the forward rotational force or the reverse rotational force is transmitted to the maintenance unit during the cleaning. This causes the following problem. Where a sheet is set on, e.g., a manual sheet-supply tray of the ink-jet printer during the cleaning, the sheet is fed into the ink-jet printer even though the cleaning is being performed, because the sheet-feed roller is being driven. The sheet fed into the ink-jet printer is fed in the ink-jet printer in a sheet feeding direction and in a direction opposite to the sheet feeding direction, which may cause a jamming of the sheet. In particular, where the sheet is fed in the direction opposite to the sheet feeding direction at a position in the ink-jet printer at which the feeding of the sheet in the direction opposite to the sheet feeding direction is not assumed, a risk of the jamming of the sheet is increased.

This invention has been developed in view of the above-described situations, and it is an object of the present invention to provide an image recording apparatus capable of preventing a jamming of a sheet in the image recording apparatus even where the sheet is inserted into the image recording apparatus during cleaning for a recording head.

The object indicated above may be achieved according to the present invention which provides an image recording apparatus comprising: a sheet-feed mechanism configured to perform a feeding operation in which the sheet-feed mechanism feeds a sheet along a sheet feeding path; a sheet-detect portion configured to detect a presence of the sheet at a specific position on the sheet feeding path; an image recording portion having a nozzle face in which nozzles are formed and configured to record an image on the sheet fed through the sheet feeding path by ejecting ink droplets through the nozzles; a cap configured to be movable between a first position at which the cap covers the nozzle face and a second position at which the cap is distant from the nozzle face; a sucking mechanism configured to perform a sucking operation in which the sucking mechanism sucks air or liquid from an inside of the cap in a state in which the sucking mechanism is communicated with the cap; a drive source configured to generate a drive force for driving the sheet-feed mechanism and the sucking mechanism; a drive-force transmitting mechanism configured to transmit one of a forward-direction drive force and a reverse-direction drive force generated by the drive source to the sheet-feed mechanism and the sucking mechanism respectively as a drive force for the feeding operation in one direction by the sheet-feed mechanism and as a drive force for the sucking operation of the sucking mechanism, and configured to transmit the other of the forward-direction drive force and the reverse-direction drive force to the sheet-feed mechanism as a drive force for the feeding operation in another direction by the sheet-feed mechanism; and a controller configured to control the drive source such that the sheet is fed in the one direction and discharged without the feeding of the sheet in said other direction by the sheet-feed mechanism after the sheet-detect portion has detected the sheet during the operation of the sucking mechanism.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which:

FIGS. 4A and 4B are cross-sectional views of a purging mechanism 44, wherein FIG. 4A shows a state in which a cap 46 is not lifted up while FIG. 4B shows a state in which the cap 46 is lifted up;

FIGS. 5A to 5D are plan views of a port switching mechanism 59, wherein FIG. 5A shows a state in which an air sucking port 93 is not communicated with any of ports 94-98, FIG. 5B shows the air sucking port 93 and the Bk port 95 are communicated with each other, FIG. 5C shows a state in which the air sucking port 93 is not communicated with any of the ports 94-98, and FIG. 5D shows a state in which the air sucking port 93 and the Co port 96 are communicated with each other;

FIGS. 7A and 7B are views for explaining paths of a drive force transmitted from a sheet-feed motor 76, wherein FIG. 7A is a view showing a path of the drive force where the sheet-feed motor 76 is forwardly rotated, and FIG. 7B is a view showing a path of the drive force where the sheet-feed motor 76 is reversely rotated;

DESCRIPTION OF THE EMBODIMENT

Hereinafter, there will be described an embodiment of the present invention by reference to the drawings. It is to be understood that the following embodiment is described only by way of example, and the invention may be otherwise embodied with various modifications without departing from the scope and spirit of the invention.

Figure 1:
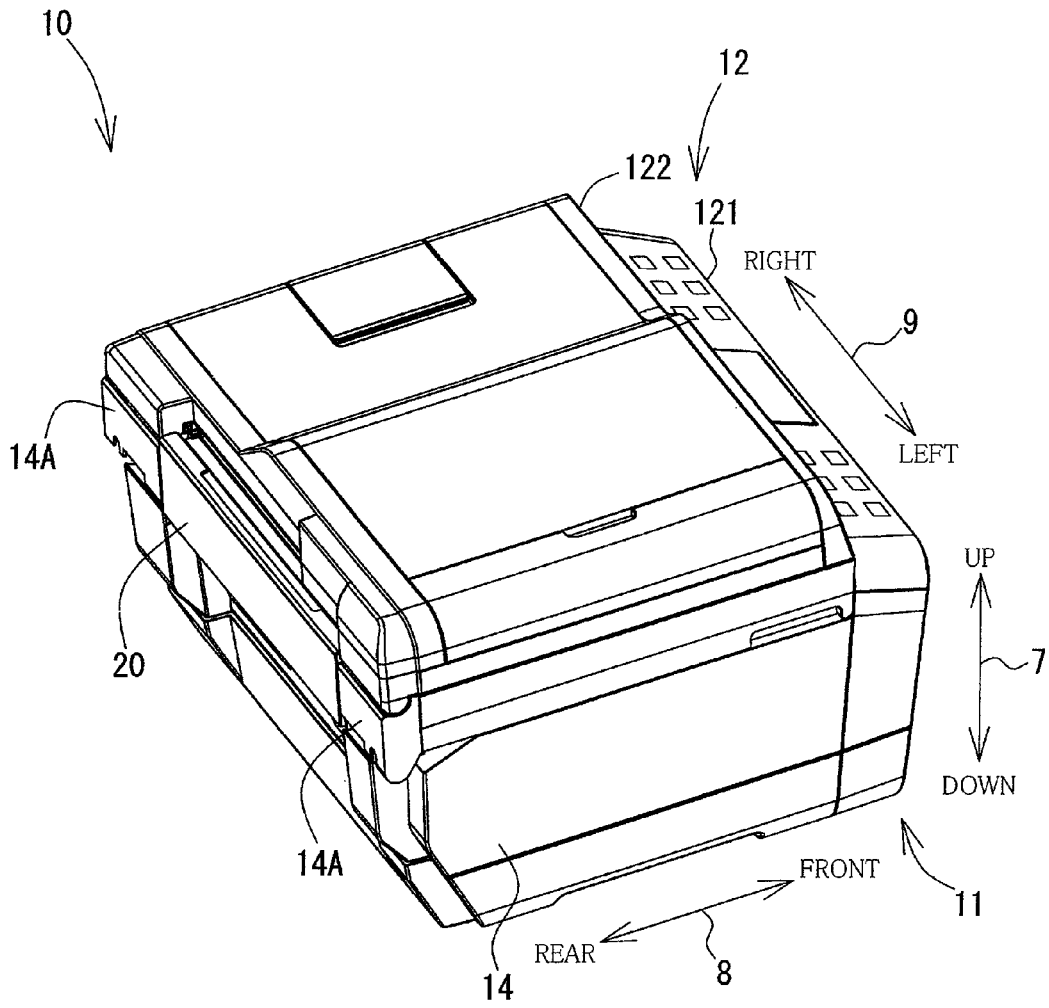
FIG. 1 is an external perspective view of a multi-function apparatus 10 as an example of an embodiment of the present invention.

FIG. 1 is a perspective view of a multi-function apparatus 10 as an example of an image recording apparatus as an embodiment of the present invention. In the following explanation, there will be expressed (a) an upward and downward direction 7 on the basis of a state in which the multi-function apparatus 10 is normally used or placed (i.e., a state of the multi-function apparatus 10 shown in FIG. 1), (b) a frontward and rearward direction 8 by regarding a side of the multi-function apparatus 10 on which an operation panel 121 is provided as a front side, and (c) a rightward and leftward direction 9 in a state in which the multi-function apparatus 10 is seen from the front.

An image reading section 12 is provided at an upper portion of the multi-function apparatus 10. The operation panel 121 is provided on an upper portion of the front side of the multi-function apparatus 10. A printing section 11 of ink-jet recording type is provided at a lower portion of the multi-function apparatus 10. The multi-function apparatus 10 has various functions such as a facsimile function, a printer function, a scanner function, and a copying function. It is noted that, in the present embodiment, there will be explained that the multi-function apparatus 10 has only a one-side image recording function as the printer function, but this multi-function apparatus 10 may have a both-side image recording function.

<Construction of Image Reading Section 12>

The image reading section 12 is provided on the printing section 11 and includes a scanner section 122. The scanner section 122 is constituted as a flatbed scanner (i.e., an FBS) and an automatic document feeder (i.e., an ADF), but, in the present invention, the scanner section 122 may have any construction as along as the scanner section 122 is configured to read an image recorded on a document. Thus, a detailed explanation thereof is omitted in this description.

<Construction of Operation Panel 121>

The operation panel 121 for operating the printing section 11 and the scanner section 122 is provided on a front portion of an upper face of the multi-function apparatus 10 on a front side of the scanner section 122. The operation panel 121 includes various operational buttons and a liquid crystal display portion. The multi-function apparatus 10 is operated on the basis of a command inputted from the operation panel 121.

<Construction of Printing Section 11>

Figure 2:
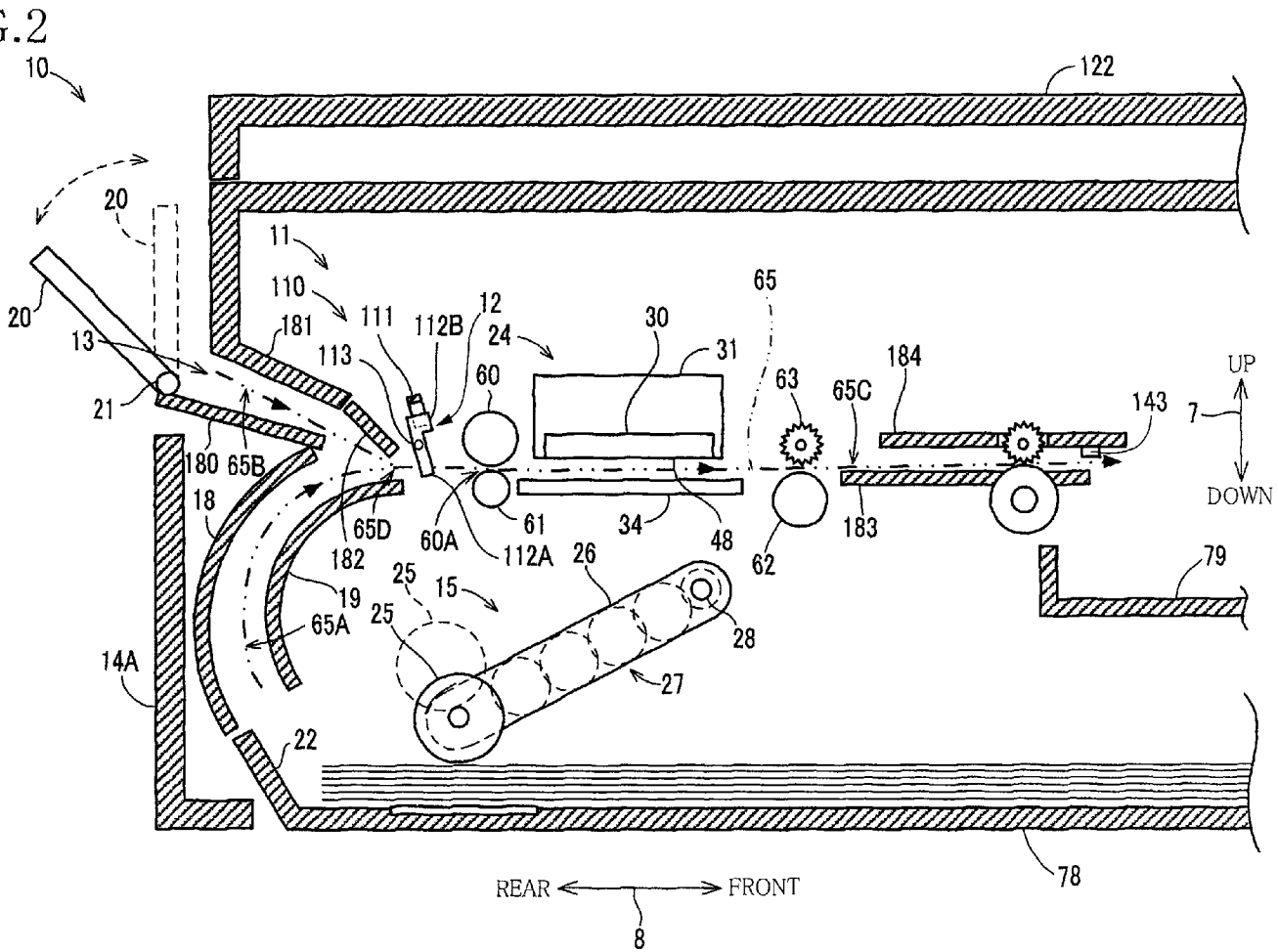
FIG. 2 is an elevational view in vertical cross section schematically showing an internal structure of a printing section 11.

As shown in FIGS. 1 and 2, the printing section 11 includes a casing 14 having openings respectively formed in front and back faces thereof Components of the printing section 11 are disposed in the casing 14. An accommodating chamber is defined so as to be continuous from an opening, not shown, formed in a front face of the printing section 11 to an inner portion of the casing 14. A sheet-supply cassette 78 as an inside sheet placed portion of a sheet placed portion is mounted on the accommodating chamber. The sheet-supply cassette 78 is configured to be insertable into and removable from the casing 14 through the opening formed in the front face thereof in the frontward and rearward direction 8. The sheet-supply cassette 78 can hold recording sheets of various sizes. It is noted that the multi-function apparatus 10 as the present embodiment is configured such that only a single sheet-supply cassette 78 can be mounted, but the multi-function apparatus 10 may be configured such that a plurality of sheet-supply cassettes 78 can be mounted.

In a back face 14A of the printing section 11, there is disposed a manual sheet-supply tray 20 as an outside sheet placed portion of the sheet placed portion at a height between the scanner section 122 and the sheet-supply cassette 78 so as to be openable and closable. As indicated by broken line arrow in FIG. 2, the manual sheet-supply tray 20 is opened and closed by being pivoted about a pivotal shaft 21. FIG. 1 shows a state of the manual sheet-supply tray 20 in which the manual sheet-supply tray 20 is closed. FIG. 2 shows by solid lines the state of the manual sheet-supply tray 20 in which the manual sheet-supply tray 20 is opened and shows by broken lines a state of the manual sheet-supply tray 20 in which the manual sheet-supply tray 20 is closed. The recording sheets of various sizes can be mounted on the manual sheet-supply tray 20 in the state in which the manual sheet-supply tray 20 is opened. A back opening 13 is formed in the back face 14A of the printing section 11 at a position opposed to a basal end portion or a lower end portion of the manual sheet-supply tray 20. Each recording sheet is inserted from the back opening 13 frontward by a user while being supported on a sheet mount face of the manual sheet-supply tray 20.

There will be next explained the construction of the printing section 11 in greater detail with reference to FIG. 2. FIG. 2 omits an illustration of a front portion of the sheet-supply cassette 78 (i.e., a right portion thereof in FIG. 2). In addition to the sheet-supply cassette 78, the printing section 11 includes a sheet-supply portion 15 configured to pick up each recording sheet from the sheet-supply cassette 78 and supply the picked recording sheet, an image recording portion 24 of ink-jet recording type configured to eject ink droplets onto the recording sheet supplied by the sheet-supply portion 15 to form an image on the recording sheet, and so on.

<Sheet Feeding Path 65>

As shown in FIG. 2, in the printing section 11, there is formed a sheet feeding path 65 extending from the sheet-supply cassette 78 and the manual sheet-supply tray 20 to a discharged-sheet holding portion 79 as a discharged-sheet placed portion via the recording portion 24. The sheet feeding path 65 is constituted by (a) a curved path 65A extending from an distal end or a back-side end portion of the sheet-supply cassette 78 to the recording portion 24, (b) a sheet feeding path 65B extending from a distal end or a front-side end portion of the manual sheet-supply tray 20 to a meeting point 65D at which the sheet feeding path 65 and the curved path 65A meet each other, and (c) a sheet discharging path 65C extending from the recording portion 24 to the discharged-sheet holding portion 79. It is noted that the discharged-sheet holding portion 79 may be configured to be integral with the sheet-supply cassette 78 or may be fixed to a frame of the printing section 11. Further, the sheet feeding path 65 is constituted by the curved path 65A, the sheet feeding path 65B, and the sheet discharging path 65C and extends from a portion of the printing section 11 on which is placed a recording sheet on which an image has not been recorded, to a portion of the printing section 11 onto which is placed a recording sheet on which an image has been recorded, via a position facing the recording head 30.

The curved path 65A is a curved path extending from a position around an upper end of an inclined sheet-separate prate 22 provided on the sheet-supply cassette 78 to the recording portion 24. The recording sheet is fed backward from the sheet-supply cassette 78. The recording sheet is fed through the curved path 65A at a back portion of the multi-function apparatus 10 so as to make an upward U-turn. Then, the recording sheet is fed frontward. The curved path 65A is defined by an outer guide member 18 and an inner guide member 19 facing each other with a predetermined distance interposed therebetween. It is noted that each of the outer guide member 18 and the inner guide member 19, and a first lower guide member 180, a first upper guide member 181, a second upper guide member 182, a second lower guide member 183, and a third upper guide member 184 which will be explained below extends in a direction perpendicular to a sheet surface of FIG. 2 (i.e., the rightward and leftward direction 9 in FIG. 1).

The sheet feeding path 65B is a straight path extending from the back opening 13 of the printing section 11 to the meeting point 65D. The recording sheet is inserted through the back opening 13 and the sheet feeding path 65B so as to contact a nipping position 60A of a first sheet-feed roller 60 and a pinch roller 61. The sheet feeding path 65B is defined by the first lower guide member 180 and the first upper guide member 181 facing each other with a predetermined distance interposed therebetween. The second upper guide member 182 is provided on a downstream side of the first upper guide member 181 in a sheet feeding direction. Here, the sheet feeding direction is a direction in which the recording sheet is fed through the sheet feeding path 65 (i.e., a direction indicated by two-dot chain line arrow in FIG. 2). The second upper guide member 182 extends so as to connect a distal end or a front end portion of the first upper guide member 181 and a position on an upper side of the meeting point 65D. The second upper guide member 182 guides the recording sheet inserted from the manual sheet-supply tray 20, to the nipping position 60A via the meeting point 65D. It is noted that, in the present embodiment, the first lower guide member 180 and the outer guide member 18 are formed independently of each other but may be formed integrally with each other. Further, the first upper guide member 181 and the second upper guide member 182 are formed independently of each other but may be formed integrally with each other.

The sheet discharging path 65C is defined by the second lower guide member 183 and the third upper guide member 184 provided on a downstream side of the recording portion 24 in the sheet feeding direction. The sheet discharging path 65C guides an image-recorded recording sheet fed by a second sheet-feed roller 62, toward a downstream side in the sheet feeding direction while supporting a lower surface of the recording sheet. The third upper guide member 184 is disposed on an upper side of the second lower guide member 183. The third upper guide member 184 and the second lower guide member 183 are disposed so as to face each other with a predetermined distance therebetween such that the recording sheet can pass through therebetween.

<Sheet-supply Portion 15>

The sheet-supply portion 15 is for feeding each recording sheet accommodated in the sheet-supply cassette 78 toward the curved path 65A. The sheet-supply portion 15 includes a sheet-supply roller 25, a sheet-supply arm 26, and a sheet-supply drive-force transmitting mechanism 27. The sheet-supply roller 25 is disposed on an upper side of the sheet-supply cassette 78. The sheet-supply roller 25 is rotatably supported by a shaft at a distal end (i.e., a free end) of the sheet-supply arm 26. The sheet-supply roller 25 is for picking up an uppermost one of the recording sheets accommodated in the sheet-supply cassette 78 and supplying the uppermost recording sheet toward the curved path 65A. The sheet-supply roller 25 is driven and rotated by a drive force of a sheet-supply motor, not shown, transmitted via the sheet-supply drive-force transmitting mechanism 27. It is noted that the sheet-supply drive-force transmitting mechanism 27 is supported by shafts in the sheet-supply arm 26 and constituted by a plurality of gears arranged in a straight line generally along a direction in which the sheet-supply arm 26 extends. The sheet-supply roller 25 is moved upward and downward with the pivotal movement of the sheet-supply arm 26 about a pivotal shaft 28, whereby the sheet-supply roller 25 can contact an upper surface of the uppermost recording sheet accommodated in the sheet-supply cassette 78.

<Register Sensor 110>

In the curved path 65A, there is provided a register sensor 110 for detecting a position of a leading end of the recording sheet supplied from the sheet-supply cassette 78 and fed through the curved path 65A, or a position of a leading end of the recording sheet inserted from the manual sheet-supply tray 20 via the sheet feeding path 65B. That is, the register sensor 110 is configured to sense a presence of the sheet at a specific position on the sheet feeding path 65. The specific position is located on an upstream side of a position on the sheet feeding path 65 which faces to the recording portion 24, in the sheet feeding direction. The register sensor 110 is constituted by (a) a rotatable member 112 having detecting elements 112A, 112B and (b) an optical sensor 111 such as a photo interrupter having a light emitting element (e.g., a light-emitting diode) for emitting light and a light receiving element (e.g., a photo transistor) for receiving the light emitted from the light emitting element, for example. The rotatable member 112 is rotatable about a support shaft 113. The detecting element 112A is projected from the support shaft 113 to the curved path 65A. In a state in which an external force is not applied to the rotatable member 112, the detecting element 112B enters into a light path extending from the light emitting element to the light receiving element of the optical sensor 111 and interrupts the light passing through this light path.

<Recording Portion 24>

Figure 3:
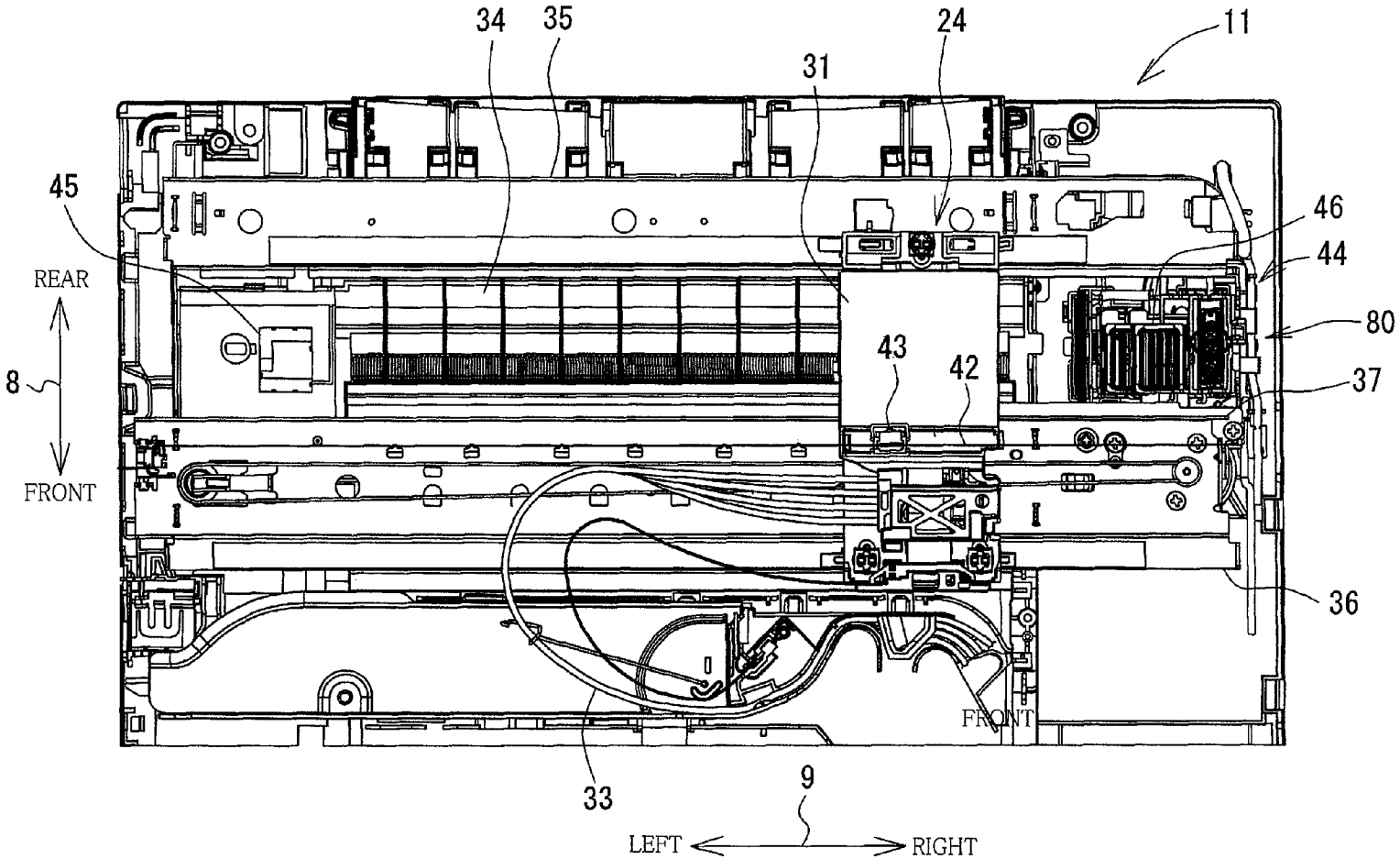
FIG. 3 is a plan view partially showing the internal structure of the printing section 11.

As shown in FIG. 2, the recording portion 24 is disposed on an upper side of the sheet-supply cassette 78. As shown in FIGS. 2 and 3, the recording portion 24 includes a carriage 31 on which is mounted a recording head 30 and which is reciprocated in a direction as a main scanning direction perpendicular to the sheet feeding direction. Inks of respective four colors, namely, cyan (C), magenta (M), yellow (Y), and black (Bk) are respectively supplied from ink cartridges, not shown, to the recording head 30 via ink tubes 33. The carriage 31 is reciprocated along guide rails 35, 36 extending in the main scanning direction. As a result, the recording head 30 is scanned or reciprocated relative to the recording sheet, and image recording is performed on the recording sheet fed on a platen 34 provided on a lower side of the recording portion 24.

As shown in FIG. 2, the recording head 30 is exposed from a lower face of the carriage 31. A plurality of nozzles, not shown, are formed in a nozzle face 48 of the recording head 30. Each of the nozzles is formed in correspondence with one of the four colors CMYBk. The inks of the four colors are ejected from the corresponding nozzles as fine ink droplets.

As shown in FIG. 3, an encoder strip 42 of a linear encoder is provided on the guide rail 36 along an end portion 37. The linear encoder detects the encoder strip 42 by a photo interrupter 43 provided on the carriage 31. The reciprocation of the carriage 31 is controlled on the basis of detection signals of the linear encoder. That is, the linear encoder constituted by the encoder strip 42 and the photo interrupter 43 functions as a recording-portion-position detecting portion and detects a position of the recording portion 24.

The first sheet-feed roller 60 and the pinch roller 61 are provided between a terminal end of the curved path 65A and the recording portion 24. The first sheet-feed roller 60 and the pinch roller 61 function as a pair. The pinch roller 61 is disposed on a lower side of the first sheet-feed roller 60 and held in pressing contact with a roller surface of the first sheet-feed roller 60 by an elastic member, not shown, such as a spring. The first sheet-feed roller 60 and the pinch roller 61 feed the recording sheet fed through the curved path 65A and the sheet feeding path 65B, onto the platen 34 while nipping. Further, the second sheet-feed roller 62 and a spur roller 63 are provided between the recording portion 24 and a starting end of the sheet discharging path 65C. The second sheet-feed roller 62 and the spur roller 63 function as a pair. The second sheet-feed roller 62 and the spur roller 63 feed the image-recorded recording sheet, while nipping, further toward a downstream side in the sheet feeding direction (i.e., toward the discharged-sheet holding portion 79).

Each of the first sheet-feed roller 60 and the second sheet-feed roller 62 as a sheet-feed mechanism is rotated by a drive force transmitted from a sheet-feed motor 76 as a drive source (with reference to FIG. 6) via a drive-force transmitting mechanism 140. The first sheet-feed roller 60 and the second sheet-feed roller 62 are intermittently driven during the image recording. Thus, the recording sheet is subjected to the image recording while being fed at predetermined line feed pitches. It is noted that, as shown in FIGS. 7A and 7B, the drive-force transmitting mechanism 140 is configured to transmit the drive force of the sheet-feed motor 76 to the first sheet-feed roller 60, the second sheet-feed roller 62, and a pump 142 of a sucking mechanism 141 which will be described below, or transmit the drive force of the sheet-feed motor 76 to the first sheet-feed roller 60, the second sheet-feed roller 62, and a port switching mechanism 59 as a changing portion of the sucking mechanism 141 configured to suck air or liquid from an inside of the cap 46 in a state in which the sucking mechanism 141 is communicated with the cap 46. In FIGS. 7A and 7B, each arrow indicates a direction in which the drive force is transmitted. As shown in FIG. 7A, where the sheet-feed motor 76 is forwardly rotated, the drive force of the sheet-feed motor 76 is transmitted to the drive-force transmitting mechanism 140 and then selectively to the first sheet-feed roller 60, the second sheet-feed roller 62, and the pump 142 by an operation of the drive-force transmitting mechanism 140. On the other hand, as shown in FIG. 7B, where the sheet-feed motor 76 is reversely rotated, the drive force of the sheet-feed motor 76 is transmitted to the drive-force transmitting mechanism 140 and then selectively to the first sheet-feed roller 60, the second sheet-feed roller 62, and the port switching mechanism 59 by the operation of the drive-force transmitting mechanism 140.

<Drive-force transmitting mechanism 140>

The drive-force transmitting mechanism 140 is constituted by several components such as a planetary gear and is configured to transmit a drive force of one of forward and reverse rotations of the sheet-feed motor 76 to the pump 142 which will be described below and to transmit a drive force of the other of the forward and reverse rotations of the sheet-feed motor 76 to a port switching mechanism 59 which will be described below. Specifically, in the present embodiment, where the first sheet-feed roller 60 and the second sheet-feed roller 62 are forwardly rotated in a direction in which the recording sheet is fed toward the downstream side in the sheet feeding direction by a forward-direction drive force generated by the sheet-feed motor 76, while where the first sheet-feed roller 60 and the second sheet-feed roller 62 are reversely rotated in a direction in which the recording sheet is fed toward an upstream side in the sheet feeding direction by a reverse-direction drive force generated by the sheet-feed motor 76.

<Maintenance Unit 80>

As shown in FIG. 3, a maintenance unit 80 is disposed at one of areas which are respectively located on opposite sides of the platen 34 in the rightward and leftward direction 9 and on which the recording sheet does not pass, that is, the maintenance unit 80 is disposed at a retracted position in a range in which the recording portion 24 is reciprocated. The maintenance unit 80 includes a purging mechanism 44, a waste-ink tank, not shown, and so on.

Figure 4A:
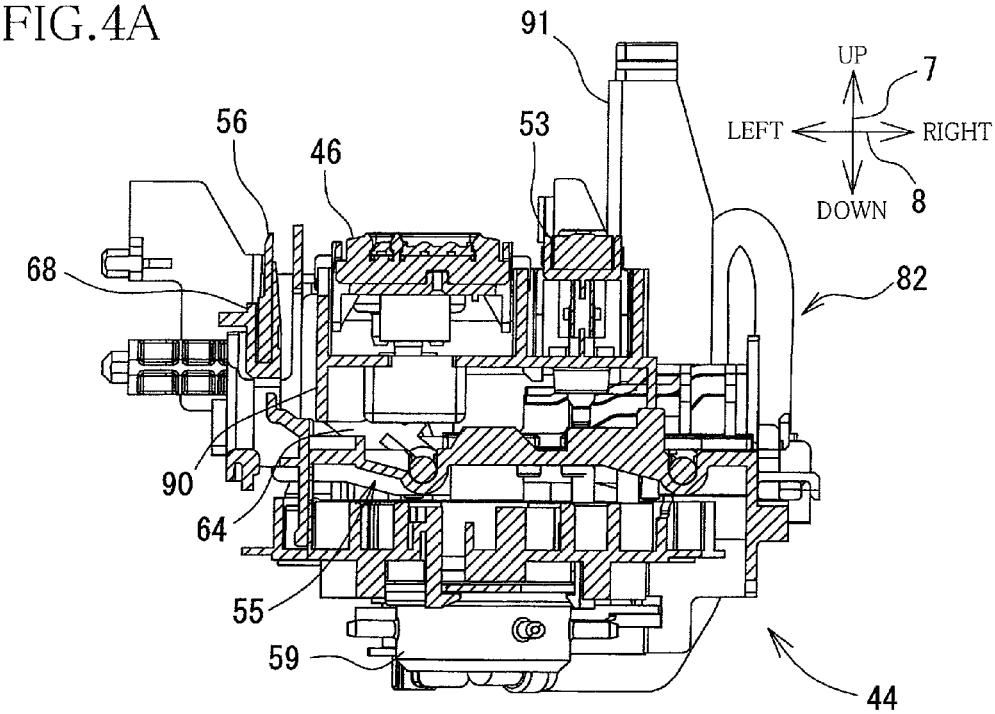
Figure 4B:
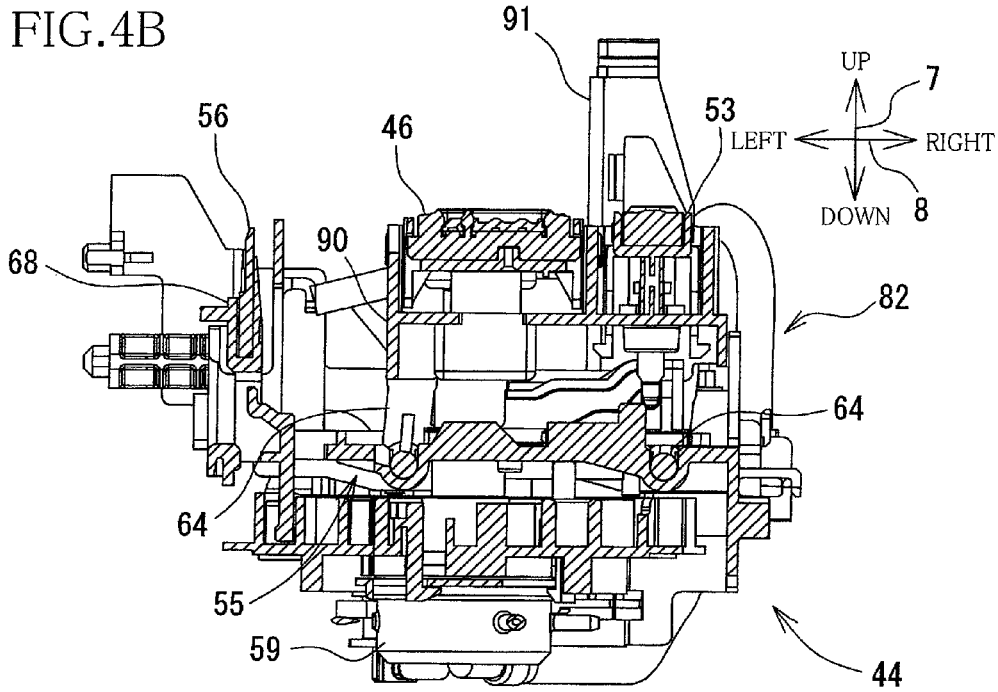

The purging mechanism 44 is configured to remove, by sucking, air bubbles and foreign materials with the inks from, e.g., the nozzles of the recording head 30. As shown in FIGS. 3, 4A, and 4B, the purging mechanism 44 includes (a) a cap 46 which covers the nozzles of the recording head 30, (b) an air-discharge cap 53 which covers air outlets of the recording head 30, (c) the pump 142 configured to perform a suction in a state in which the pump 142 is connected to the cap 46 or the air-discharge cap 53, (d) a lifting-up mechanism 55 for moving the cap 46 and the air-discharge cap 53 toward and away from the recording head 30, (e) a pump tube 82 for connecting the pump 142, the waste-ink tank and a wiper blade 56 for wiping the nozzle face 48, and so on.

The cap 46 is formed of rubber. The cap 46 comes into fluid-tight contact with the nozzle face 48 (with reference to FIG. 2) by the lifting-up mechanism 55 so as to define a space between the cap 46 and the nozzle face 48 and to surround the nozzles. An inside of the cap 46 is divided into two spaces respectively corresponding to the color inks CMY and the black ink Bk, and accordingly two spaces are defined between the cap 46 and the nozzle face 48 for the color inks and the black ink. In bottom portions of the respective spaces of the cap 46, there are formed air intakes, not shown, which are connected to the pump 142 via the port switching mechanism 59. The port switching mechanism 59 will be explained in detail below. The air-discharge cap 53 is also formed of rubber. The air-discharge cap 53 also comes into fluid-tight contact with the nozzle face 48 (with reference to FIG. 2) so as to surround the air outlets of the recording head 30.

The pump 142 is a rotary tube pump. In the present embodiment, the pump 142 includes a casing having inner wall faces and a roller rolled along the inner wall faces. The pump tube 82 is disposed between the roller and the inner wall faces of the casing, and the roller is driven. As a result, the pump tube 82 is squeezed and the ink in the pump tube 82 is pushed from an upstream portion of the pump tube 82 (e.g., the cap 46 and the air intakes of the air-discharge cap 53) toward a downstream portion of the pump 82 (e.g., the waste-ink tank).

As shown in FIG. 4A, the lifting-up mechanism 55 includes a pair of right and left equal-length links 64. The equal-length links 64 are pivoted, whereby a holder 90 is moved in parallel and changed between a stand-by position and a close-contact position. In FIG. 4A, the holder 90 is located at the stand-by position, while in FIG. 4B, the holder 90 is located at the close-contact position. The holder 90 includes a contact lever 91 protruding upward in a vertical direction. The carriage 31 presses the contact lever 91 rightward in FIGS. 4A and 4B, whereby the holder 90 is moved to the close-contact position. The cap 46 and the air-discharge cap 53 are mounted on the holder 90. When the holder 90 is moved to the close-contact position, the cap 46 and the air-discharge cap 53 come into fluid-tight contact with surroundings of the nozzles and surroundings of the air outlets of the recording head 30 (that is, the cap 46 is located at a first position). On the other hand, when the holder 90 is moved to the stand-by position, the cap 46 is moved away from the recording head 30 (that is, the cap 46 is located at a second position). It is noted that the movement of the carriage 31 is caused by a motor (e.g., a carriage (CR) driving motor 311 with reference to FIG. 6). Further, as long as the position of the cap 46 is changed between the first position and the second position, the construction of the cap 46 for changing the position thereof is not limited to the above-described construction in which the lifting-up mechanism 55 is used for the change.

Figure 6:
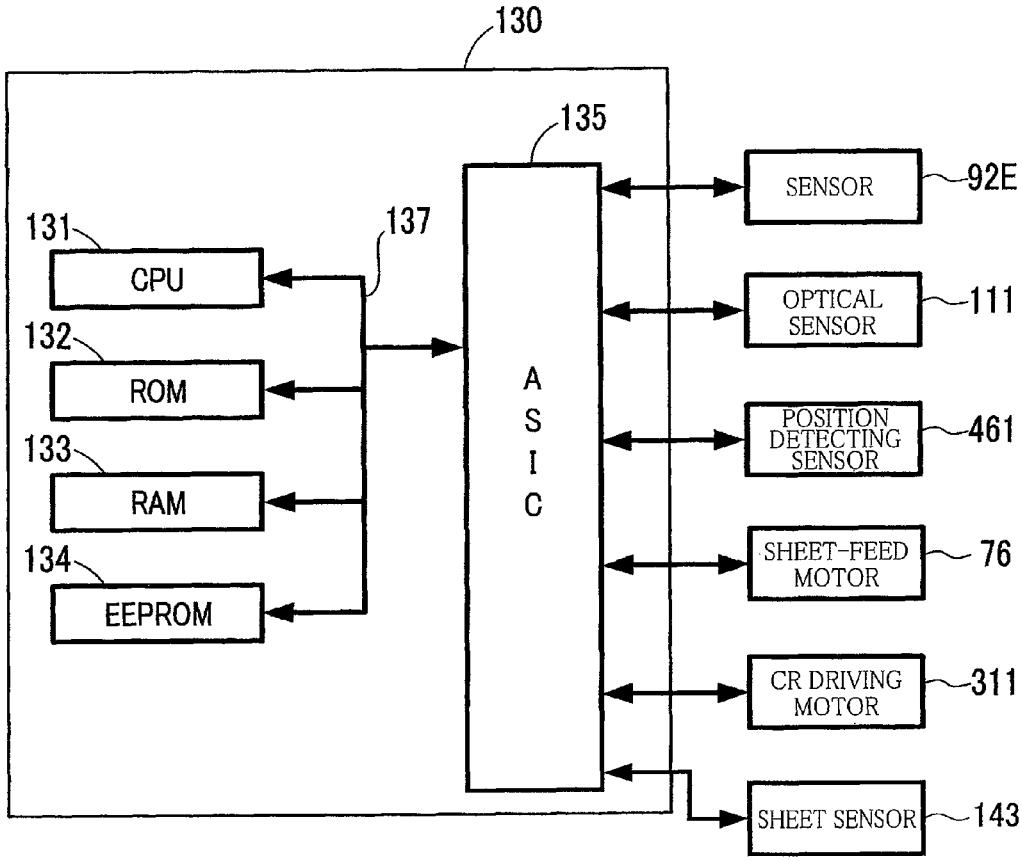
FIG. 6 is a block diagram showing a configuration of a controller 130.
Figure 7A:
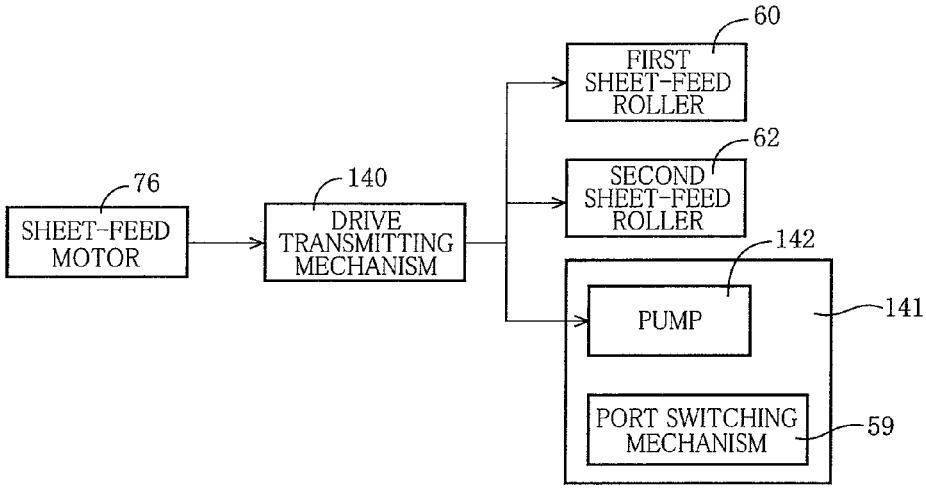
Figure 7B:
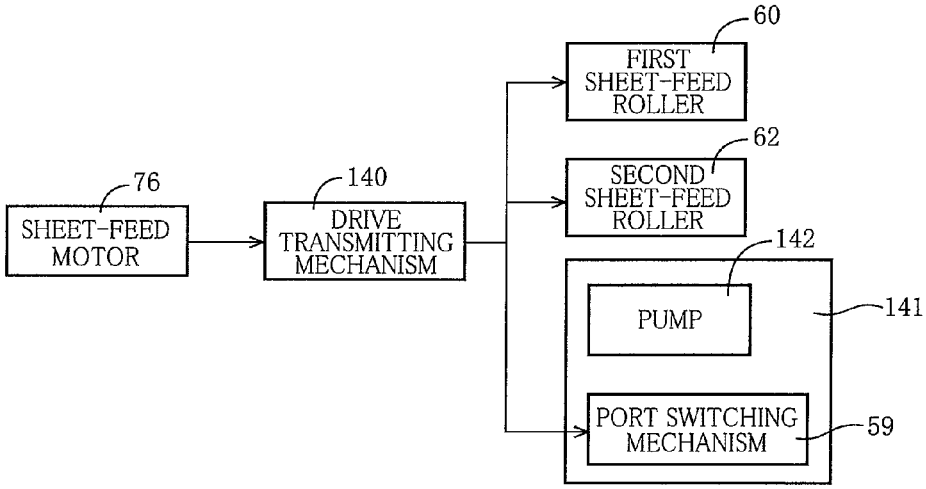

A position detecting sensor 461 as a cap-position detecting portion is provided near the cap 46 with reference to FIG. 6. The position detecting sensor 461 is configured to detect the position of the cap 46. The position detecting sensor 461 is constituted by (a) a slide member which is slid upward and downward in accordance with the change of the position of the cap 46 and (b) an optical sensor such as a photo interrupter having a light emitting element (e.g., a light-emitting diode) for emitting light and a light receiving element (e.g., a photo transistor) for receiving the light emitted from the light emitting element, for example. When the cap 46 is located at the first position, the slide member is positioned in a light path extending from the light emitting element to the light receiving element and interrupts the light traveling through the light path. The position detecting sensor 461 detects the position of the cap 46 on the basis of the presence or absence of the interruption.

The wiper blade 56 is fitted in a wiper holder 68 and provided to protrude and retract from the wiper holder 68. The wiper blade 56 is formed of rubber. A length of the wiper blade 56 (i.e., a dimension in a direction perpendicular to a sheet surface of FIG. 4) corresponds to a length of the nozzle face 48. The wiper blade 56 is protruded from the wiper holder 68 so as to be brought into contact with the nozzle face 48. When the carriage 31 is slid in a state in which the wiper blade 56 is held in contact with the lower face (i.e., the nozzle face 48) of the recording head 30, the wiper blade 56 wipes ink adhering the nozzle face 48, that is, the wiper blade 56 performs wiping. The protruding and retracting of the wiper blade 56 are controlled by a cum mechanism, not shown, and the wiper blade 56 is protruded when the recording head 30 is slid toward an image recording area after the purging operation is finished.

As shown in FIG. 3, a waste-ink tray 45 is provided on an outside of the image recording area of the carriage 31 and on an opposite side of the purging mechanism 44. This waste-ink tray 45 is for receiving the ink ejected from the recording head 30 in what is called a flushing. This flushing is carried out as a different operation from the above-described purging, and maintenances such as removal of the air bubbles and mixed ink from the recording head 30 are performed in the flushing. It is noted that felts are laid in the waste-ink tray 45, and the ink ejected in the flushing is absorbed and held in the felts.

<Port Switching Mechanism 59>

The port switching mechanism 59 (with reference to FIGS. 4A and 4B) changes a communication state of the cap 46 and the air-discharge cap 53, and the pump 142 to a connecting state or a disconnecting state. As shown in FIGS. 4A, 4B, and 5, the port switching mechanism 59 includes a cover 99 in which six ports 93-98 are formed and a discal switching member 92 disposed in the cover 99. The switching member 92 is rotated by the sheet-feed motor 76 (with reference to FIG. 6) and connects the ports 93-98 in a manner described below. The cover 99 is formed of resin and has a cylindrical shape having a bottom. The air sucking port 93 is formed at a central portion of a bottom face of the cover 99. The pump tube 82 is connected to the air sucking port 93. The pump tube 82 is connected to the waste-ink tank via the pump 142.

The other five ports 94-98 are circumferentially formed in a side wall of the cover 99 so as to be spaced at predetermined pitches. The air discharging port 94 is communicated with the air-discharge cap 53 (with reference to FIGS. 4A and 4B) by using a tube, not shown, different from the pump tube 82. The Bk port 95 is communicated with the cap 46 (with reference to FIGS. 4A and 4B) by using a tube, not shown, different from the above-described tubes. Specifically, the Bk port 95 is communicated with the space for the black ink which is defined by the cap 46 and the nozzle face 48. The Co port 96 is communicated with the cap 46 (with reference to FIGS. 4A and 4B) by using a tube, not shown, different from the above-described tubes. Specifically, the Co port 96 is communicated with the space for the color inks which is defined by the cap 46 and the nozzle face 48. The ambient air ports 97, 98 are open to ambient air.

The ink sucked from the recording head 30 by the maintenance unit 80 is sent to the waste-ink tank in the following manner. There will be explained a procedure of the ink suction with reference to FIGS. 5A to 5D.

When the carriage 31 is slid and presses the contact lever 91 rightward, the holder 90 is moved to the close-contact position as shown in FIG. 4B. That is, the cap 46 comes into close contact with the nozzle face 48 by the lifting-up mechanism 55, so that the space is defined by the cap 46 and the nozzle face 48 (that is, the cap 46 is located at the first position). Then, the switching member 92 is driven, whereby the air sucking port 93 is communicated with the Bk port 95 with reference to FIG. 5B (hereinafter, this state may be referred to as a "second state" or a "communicating state"). That is, the space corresponding to the black ink which is defined by the cap 46 and the nozzle face 48 is connected to the pump 142. When the pump 142 is driven in the second state, a negative pressure is applied to the space corresponding to the black ink which is defined by the cap 46 and the nozzle face 48, whereby the accumulated black ink is sucked toward the pump 142. The sucked ink is absorbed into the waste-ink tank via the pump tube 82. When a predetermined length of time (e.g., a length of time in which the ink is sufficiently sucked from the nozzles, for example) has passed from a start of the ink suction, the switching member 92 is driven, whereby a first state or a non-communicating state (with reference to FIG. 5A) is established in which the air sucking port 93 is not communicated with any of the ports 94-98. That is, the space defined by the cap 46 and the nozzle face 48 is disconnected from the ambient air and is not communicated with the pump 142. As a result, an amount of the ink sucked by the pump 142 is stabilized.

Then, the switching member 92 is driven, whereby the air sucking port 93 is communicated with the Co port 96 with reference to FIG. 5D (hereinafter, this state may also be referred to as the "second state" as in the case in FIG. 5B). That is, the space corresponding to the color inks which is defined by the cap 46 and the nozzle face 48 is connected to the pump 142. When the pump 142 is driven in this state, a negative pressure is applied to the space corresponding to the color inks which is defined by the cap 46 and the nozzle face 48, whereby the accumulated color inks are sucked toward the pump 142. The sucked inks are absorbed into the waste-ink tank via the pump tube 82. When a predetermined length of time (e.g., a length of time in which the inks are sufficiently sucked from the nozzles, for example) has passed from a start of the ink suction, the switching member 92 is driven, whereby the first state (with reference to FIG. 5C) is established. That is, the space defined by the cap 46 and the nozzle face 48 is disconnected from the ambient air and is not communicated with the pump 142. As a result, an amount of the inks sucked by the pump 142 is stabilized. Thereafter, the carriage 31 is slid and is moved away from the contact lever 91, the holder 90 is moved to the stand-by position as shown in FIG. 4A. That is, the cap 46 is moved away from the nozzle face 48 to the second position by the lifting-up mechanism 55.

Figure 5A:
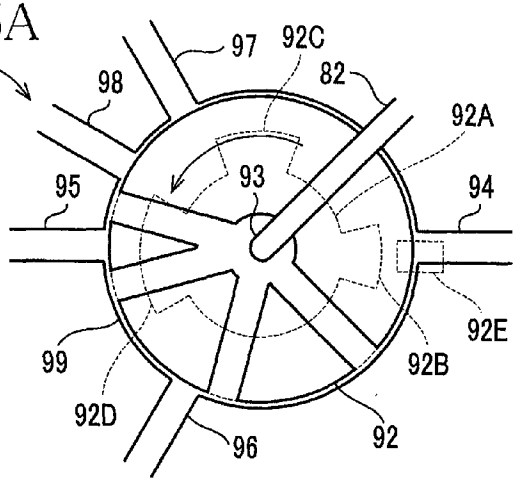
Figure 5B:
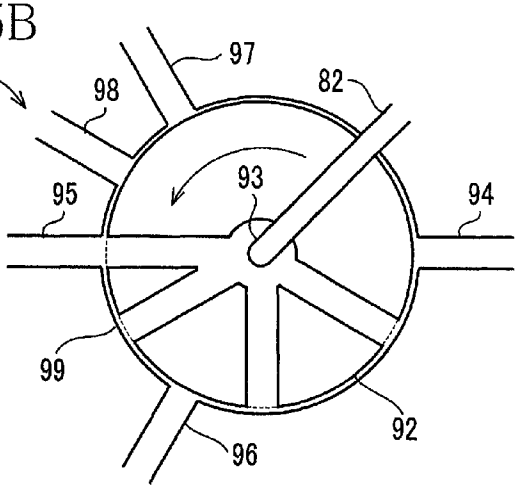
Figure 5C:
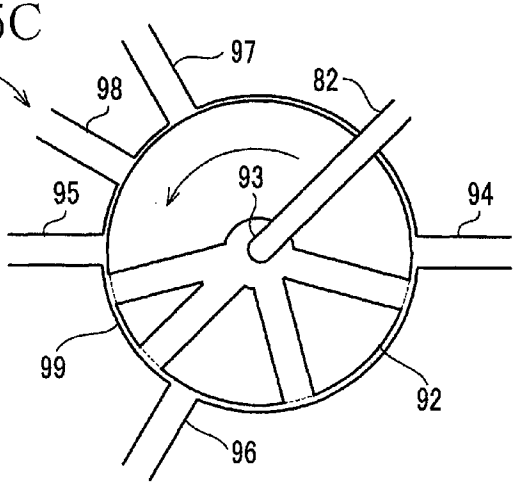
Figure 5D:
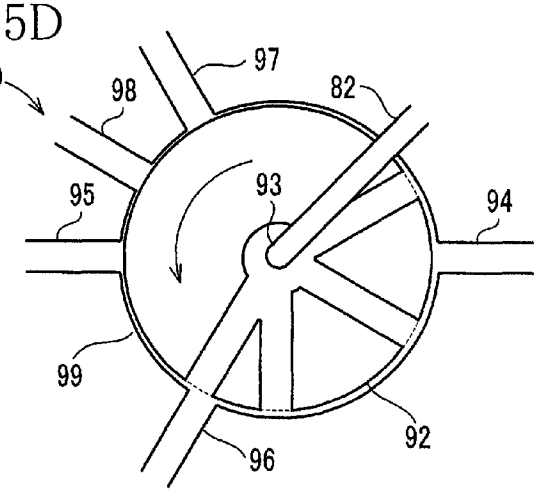

As indicated by broken lines in FIG. 5A, a rotatable member 92A rotated integrally with the switching member 92 is provided on an upper portion or a lower portion of the switching member 92. The rotatable member 92A has projecting portions 92B, 92C, 92D projecting outward in a radial direction of the rotatable member 92A. The projecting portions 92B, 92C, 92D are respectively disposed at positions whose phases are different from each other relative to the rotation of the rotatable member 92A. The projecting portions 92B, 92C, 92D are distant from each other at predetermined rotational angles of the rotatable member 92A. Further, a sensor 92E is disposed at a position opposed to an outer circumferential face of the rotatable member 92A. Where the sensor 92E is opposed to any of the projecting portions 92B, 92C, 92D, an electric signal representing "ON" is outputted from the sensor 92E. Where the sensor 92E is not opposed to any of the projecting portions 92B, 92C, 92D, an electric signal representing "OFF" is outputted from the sensor 92E. The rotational phase of the switching member 92 is recognized on the basis of a cycle of the output (i.e., "ON" or "OFF") of the sensor 92E.

<Controller 130>

Hereinafter, there will be explained a general configuration of a controller 130 with reference to FIG. 6. The controller 130 performs the sheet-discharge control in accordance with each flow-chart described below to realize the present invention.

The controller 130 is configured to control overall operations of the multi-function apparatus 10. The controller 130 is constituted as a microcomputer mainly including a CPU 131, a ROM 132, a RAM 133, an EEPROM 134, and the ASIC 135. These are connected to each other via an internal bus 137.

The ROM 132 stores, e.g., programs for controlling various operations of the multi-function apparatus 10 by the CPU 131 and programs for performing a state judging processing which will be described below. The RAM 133 is used as a storage area for temporarily storing data, signals, and so on used when the CPU 131 performs the above-described programs or used as a working area for a data processing. The EEPROM 134 stores flags and the like which are to be kept also after the multi-function apparatus 10 is turned off.

The optical sensor 111, the sheet-feed motor 76, and so on are connected to the ASIC 135. Into the ASIC 135 is incorporated a drive circuit for controlling the sheet-feed motor 76. When a drive signal for rotating the sheet-feed motor 76 is inputted from the CPU 131 to the drive circuit, a drive current corresponding to the drive signal is outputted from the drive circuit to the sheet-feed motor 76. As a result, the sheet-feed motor 76 is rotated forwardly or reversely at a predetermined speed. Then, the switching member 92, the first sheet-feed roller 60, and the second sheet-feed roller 62 are rotated by the rotation of the sheet-feed motor 76.

The optical sensor 111 outputs an analog electric signal (i.e., a voltage signal or a current signal) in accordance with an intensity of the light received by the light receiving element. The outputted signal is inputted to the controller 130, and then the controller 130 judges whether an electric level (i.e., a voltage value or a current value) is equal to or higher than a predetermined threshold value or not. Where the inputted signal is equal to or higher than the predetermined threshold value, the controller 130 judges that the inputted signal is a high level signal. On the other hand, where the inputted signal is lower than the predetermined threshold value, the controller 130 judges that the inputted signal is a low level signal.

<Sheet-discharge Control>

In the printing section 11 configured as described above, the controller 130 performs the sheet-discharge control in which the recording sheet sensed by the register sensor 110 is discharged to the discharged-sheet holding portion 79 during a cleaning performed by the maintenance unit 80. Here, the cleaning includes the purging, the wiping, the flushing, and so on. There will be hereinafter explained a sheet-discharge controlling processing for the sheet-discharge control with reference to a flow-chart in FIG. 8. This sheet-discharge controlling processing is performed when the user has commanded the cleaning for the recording portion 24 by operating the operation panel 121, for example.

In the following explanation, it is assumed for easier understanding purposes that where the sheet-feed motor 76 is rotated forwardly, the recording sheet is fed toward the downstream side in the sheet feeding direction and the pump 142 is driven, while where the sheet-feed motor 76 is rotated reversely, the recording sheet is fed toward the upstream side in the sheet feeding direction and the port switching mechanism 59 switches the state of the cap 46 and the pump 142 to the connecting state or the disconnecting state. In the present invention, a relationship between the forward and reverse rotations of the sheet-feed motor 76 and the respective operations assigned thereto may be an inverse relationship to the above-described relationship. Further, in the following explanation, it is assumed for easier understanding purposes that where the recording sheet has been sensed by the register sensor 110, the high level signal is outputted from the optical sensor 111, while where the recording sheet has not been sensed by the register sensor 110, the low level signal is outputted from the optical sensor 111. Further, in the above-described explanation, the purging mechanism 44 performs the suction of the black ink and the suction of the color inks independently of each other, but, in the following explanation, it is assumed for easier understanding purposes that the suction of the black ink and the suction of the color inks are performed collectively as the suction of the ink.

Where the cleaning for the recording portion 24 has been commanded by the user having operated the operation panel 121, the controller 130 judges in S10 whether the recording sheet has been inserted or set in the multi-function apparatus 10 or not. Where the high level signal has been inputted from the optical sensor 111, the controller 130 judges that the recording sheet has been inserted in the multi-function apparatus 10 (S10: Yes), the sheet-feed motor 76 is rotated forwardly. As a result, in S20, the recording sheet is fed toward the downstream side in the sheet feeding direction and discharged to the discharged-sheet holding portion 79. In this time, the pump 142 is driven by the forward rotation of the sheet-feed motor 76, but where the carriage 31 is located at the retracted position and the cap 46 is located at the first position for covering the nozzle face 48, the controller 130 performs the control, before performing the processing of S20, in which the carriage 31 is slid so as to be moved away from the contact lever 91 and the cap 46 is moved to the second position distant from the nozzle face 48. Accordingly, the ink is not sucked from the nozzles and so on. Further, where the carriage 31 has already been located in the image recording area, the carriage 31 has not been moved to the retracted position opposed to the maintenance unit 80. Accordingly, the ink is not sucked from the nozzles and so on.

Then, in S30, the cleaning for the recording portion 24 is started, and the ink is sucked from the nozzles and so on. Specifically, the controller 130 controls the carriage 31 such that the carriage 31 is slid to the retracted position to press the contact lever 91 rightward. As a result, the cap 46 is moved to the first position for covering the nozzle face 48. Then, the sheet-feed motor 76 is rotated reversely and the switching member 92 is driven, whereby the state of the port switching mechanism 59 becomes the second state (i.e., the state shown in FIG. 5B or 5D). As a result, the portion of the port switching mechanism 59 which corresponds to the space defined by the cap 46 and the nozzle face 48 is connected to the pump 142. Then, the sheet-feed motor 76 is forwardly rotated and the pump 142 is driven. As a result, the ink accumulated in the space defined by the cap 46 and the nozzle face 48 is sucked toward the pump 142 via the Bk port 95 or the Co port 96.

On the other hand, where the low level signal has been inputted in S10 from the optical sensor 111 to the controller 130, the controller 130 judges that the recording sheet has not been inserted or set in the multi-function apparatus 10 (S10: No). In this case, the controller 130 starts in S30 the cleaning for the recording portion 24 without performing the sheet discharging operation.

Where the controller 130 has recognized that the optical sensor has become a low level after a high level during the suction of the ink in S30, that is, the controller 130 has recognized that a trailing end of the recording sheet has reached a position on a downstream side of the register sensor 110 in the sheet feeding direction, the controller 130 continues in S170 the driving of the forward rotation of the sheet-feed motor 76 until the suction of the ink currently performed is finished, that is, the controller 130 continues the driving of the pump 142 for a length of the time corresponding to the continuation of the driving of the forward rotation of the sheet-feed motor 76. When the driving of the pump 142 for the length of the time corresponding to the continuation of the driving of the forward rotation of the sheet-feed motor 76 is finished, the controller 130 judges in S180 whether the sensed recording sheet has been discharged to the discharged-sheet holding portion 79 or not. Whether the recording sheet has been discharged or not is judged by the controller 130 on the basis of an output value of a sheet sensor 143 as a sheet-discharge detecting portion provided on the sheet discharging path 65C between the recording portion 24 and the discharged-sheet holding portion 79, for example. The sheet sensor 143 is a sensor which is disposed at a position in the sheet discharging path 65C near a sheet-discharge opening of the multi-function apparatus 10 and which senses that the recording sheet fed in the multi-function apparatus 10 has been discharged from the multi-function apparatus 10. When the sheet sensor has stopped sensing the recording sheet after sensing the recording sheet, the controller 130 judges that the recording sheet has passed through the sheet sensor and reached the discharged-sheet holding portion 79.

It is noted that, in the present embodiment, the judgment as to whether the recording sheet has been discharged or not is performed on the basis of the output value of the sheet sensor, but the controller 130 may perform this judgment on the basis that an amount of the forward rotation of the sheet-feed motor 76 has reached a predetermined rotational amount after the register sensor 110 has sensed the trailing end of the recording sheet. It is noted that the amount of the forward rotation is a rotational amount for rotating the first sheet-feed roller 60 and the second sheet-feed roller 62 in the direction in which the recording sheet is fed toward the downstream side in the sheet feeding direction. Here, the predetermined rotational amount is set at an amount enough for the recording sheet to reach the discharged-sheet holding portion 79 after the register sensor 110 has sensed the trailing end of the recording sheet. Further, the controller may perform the judgment on the basis that the first sheet-feed roller 60 or the second sheet-feed roller 62 has rotated by the predetermined rotational amount or not, instead of the rotational amount of the sheet-feed motor 76. Rotational amounts of the first sheet-feed roller 60 and the second sheet-feed roller 62 are detected by encoders respectively provided adjacent to the first sheet-feed roller 60 and the second sheet-feed roller 62, for example. In these cases, the sheet-discharge detecting portion is constituted by the register sensor 110 and the sheet-feed motor 76, (or by the register sensor 110 and the encoder of the first sheet-feed roller 60 or the second sheet-feed roller 62).

Where the controller 130 has judged that the recording sheet has been discharged to the discharged-sheet holding portion 79 (S180: Yes), this sheet-discharge controlling processing goes to S50. Where the controller 130 has judged that the recording sheet has not been discharged to the discharged-sheet holding portion 79 (S180: No), the controller 130 performs the control in which the carriage 31 is slid and is moved away from the contact lever 91. As a result, in S110, the position of the cap 46 is changed to the second position at which the cap is distant from the nozzle face 48. Further, the pump 142 is driven in the state in which the cap 46 is located at the second position. In this state, the ink is not sucked from the nozzles of the recording head 30 because the cap 46 is distant from the nozzle face 48. That is, in S110, the controller 130 performs an idle suction (i.e., a non-capping suction) for cleaning the inside of the cap 46. It is noted that the sense in S40 continues until the suction of the ink is finished, in the sense in S40 the optical sensor 111 having become the low level after the high level during the suction of the ink, that is, the trailing end of the recording sheet having reached the position on a downstream side of the register sensor 110 in the sheet feeding direction.

When the position detecting sensor 461 has sensed that the cap 46 is located at the second position, the controller 130 continues in S120-S160 the idle suction until the sensed recording sheet is discharged to the discharged-sheet holding portion 79.

Whether the recording sheet has passed through the sheet sensor or not is judged a predetermined number of times (two times in FIG. 8, namely, in S130 and S150) at predetermined intervals. Here, as each of the predetermined intervals, there is set an enough length of time for the recording sheet to be discharged from the position of the register sensor 110 to the discharged-sheet holding portion 79, for example. In each of S130 and S150, where the controller 130 has not judged that the recording sheet has not been discharged (S130: No, S150: No), the controller 130 judges that this sheet discharging operation is a sheet discharging error. In this case, in S160, the idle suction is suspended, and the controller 130 notifies the user of the sheet discharging error. For example, the notification is displayed on a liquid crystal display portion of the operation panel 121.

Where the controller 130 has not recognized that the optical sensor has become a low level after a high level during the suction of the ink in S30 (S40: No), the controller 130 performs the following normal cleaning operation. Initially in S50, after the predetermined length of time (e.g., the length of time in which the ink is sufficiently sucked from the nozzles, for example) has passed from the start of the suction of the ink, the sheet-feed motor 76 is rotated in a direction reverse to the rotational direction thereof in S20 and the switching member 92 is driven, whereby the state of the port switching mechanism 59 is changed from the second state to the first state. Thus, the space defined by the cap 46 and the nozzle face 48 is disconnected from the ambient air and is not communicated with the pump 142. As a result, the amount of the ink sucked by the pump 142 is stabilized. Then, in S60, the sheet-feed motor 76 is rotated in the same direction as in S50 and the switching member 92 is driven, whereby the state of the port switching mechanism 59 is changed from the first state to the second state. Further, in S60, the carriage 31 is slid and moved away from the contact lever 91, whereby the cap 46 is moved to the second position distant from the nozzle face 48. As a result, in S70, the sheet-feed motor 76 is forwardly rotated, whereby the idle suction is performed.

Where the controller 130 has recognized that the optical sensor 111 has become the low level after the high level during the idle suction in S70 (S80: Yes), the controller 130 continues in S120-S160 the idle suction until the sensed recording sheet is discharged to the discharged-sheet holding portion 79 or the controller 130 has judged that the sheet discharging operation is the sheet discharging error. It is noted that the sense in S80 continues until the idle suction is finished, in the sense in S80 the optical sensor 111 having become the low level after the high level during the idle suction, that is, the trailing end of the recording sheet having reached the position on a downstream side of the register sensor 110 in the sheet feeding direction.

Where the controller 130 has not performed the recognition in S80 (S80: No) and where the high level signal has been inputted from the optical sensor 111 to the controller 130 after the cleaning is finished (S90: Yes), the controller 130 judges that the recording sheet has been inserted or set in the multi-function apparatus 10 and controls the sheet-feed motor 76 such that the sheet-feed motor 76 is forwardly rotated. As a result, in S100, the recording sheet is fed toward the downstream side in the sheet feeding direction and discharged to the discharged-sheet holding portion 79. On the other hand, where the high level signal has not been inputted from the optical sensor 111 to the controller 130 after the cleaning is finished (S90: No), this sheet-discharge controlling processing is finished.

Figure 8:
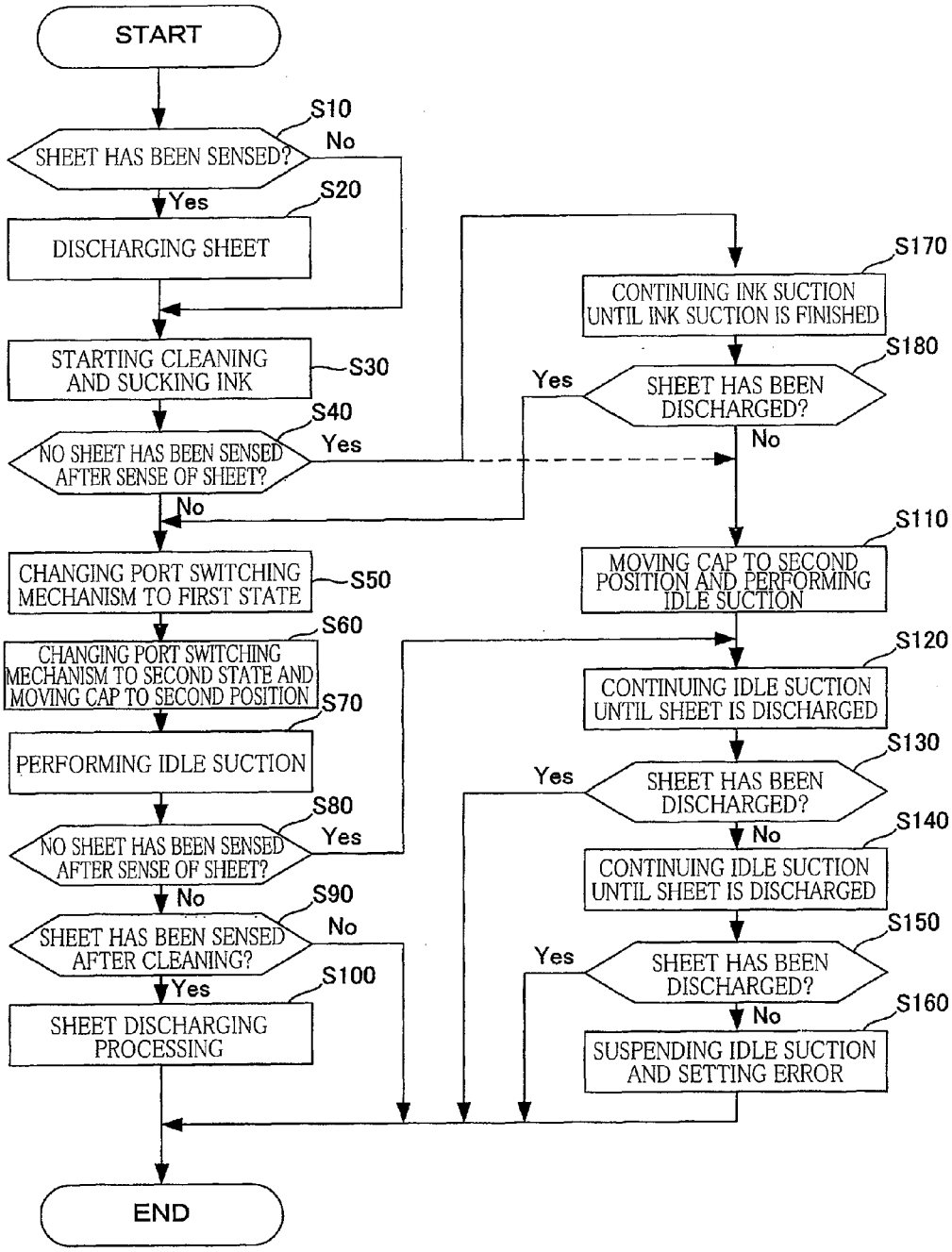
FIG. 8 is a flow-chart showing an example of a procedure of a sheet-discharge control performed by the controller 130.

It is noted that, in the above-described explanation with reference to FIG. 8, the sheet discharging operation in S120-160 is performed when the controller 130 has recognized in S40 and S80 that the optical sensor 111 has become the low level after the high level, that is, the trailing end of the recording sheet has reached the position on a downstream side of the register sensor 110 in the sheet feeding direction. However, the sheet discharging operation in S120-160 may be performed immediately after the controller 130 has recognized that the optical sensor 111 has become the high level after the low level, that is, the trailing end of the recording sheet has reached the position on a downstream side of the register sensor 110 in the sheet feeding direction. In this case, the controller 130 may omit the processings of S170 and S180. That is, this multi-function apparatus 10 may be configured such that when the controller 130 has recognized that the optical sensor 111 has become the low level after the high level during the suction of the ink in S30 (S40: Yes), the position of the cap 46 is changed to the second position in S110 as indicated by broken-line arrow in FIG. 8.

<Effects of Embodiment>

The stop of the detection of the recording sheet by the register sensor 110 after the register sensor 110 has detected the recording sheet means that the trailing end of the recording sheet has passed through the first sheet-feed roller 60 and the pinch roller 61. In this state, where the sheet-feed motor 76 has been reversely rotated and thereby the second sheet-feed roller 62 has been reversely rotated in order to change the state of the port switching mechanism 59 to perform the cleaning, there is a possibility that the recording sheet is fed in a direction opposite to the sheet feeding direction and is not appropriately inserted into the position between the first sheet-feed roller 60 and the pinch roller 61 from the downstream side in the sheet feeding direction, thereby causing jamming of the recording sheet in the multi-function apparatus 10. In the above-described embodiment, after the register sensor 110 has detected the recording sheet and then has not detected the recording sheet, the recording sheet is discharged to the discharged-sheet holding portion 79. That is, the sheet-feed motor 76 is forwardly rotated, whereby the drive force is transmitted to the first sheet-feed roller 60, the second sheet-feed roller 62, and the pump 142. As a result, the recording sheet is fed toward the downstream side in the sheet feeding direction and then is discharged to the discharged-sheet holding portion 79. Thus, it is possible to prevent the jamming of the recording sheet which is caused because the recording sheet is fed in the direction opposite to the sheet feeding direction in the multi-function apparatus 10.

Where the cap 46 is located at the first position, the liquid-tight space is defined by the cap 46 and the nozzle face 48. When the pump 142 is driven in this state, the ink is sucked from the nozzles. Where the cap 46 is located at the second position, the liquid-tight space is not formed because the cap 46 is distant from the nozzle face 48. Thus, even where the pump 142 is driven, the ink is not sucked from the nozzles. In the above-described embodiment, where the cap 46 is located at the second position, the controller 130 performs the control such that the sheet-feed motor 76 is driven in the direction in which the drive force is transmitted to the first sheet-feed roller 60, the second sheet-feed roller 62, and the pump 142 to discharge the recording sheet. Thus, the ink is not sucked from the nozzles, thereby preventing a wasteful ink consumption.

The controller 130 may forwardly rotate the sheet-feed motor 76 when the register sensor 110 has detected the leading end of the recording sheet. Where the multi-function apparatus 10 is thus configured, the drive force generated by the forward rotation of the sheet-feed motor 76 is transmitted to the first sheet-feed roller 60, the second sheet-feed roller 62, and the pump 142, and then the recording sheet is fed toward the downstream side in the sheet feeding direction and discharged to the discharged-sheet holding portion 79. Thus, even where the recording sheet is inserted or set in the multi-function apparatus 10 during the cleaning of the recording head 30, it is possible to prevent the jamming of the recording sheet in the multi-function apparatus 10.

Since the controller 130 continues the suction by the pump 142 until the suction of the air or the liquid in the cap 46 is finished, the suction of the ink is not stopped during the suction. Further, where the sheet sensor has not detected the discharge of the recording sheet from the multi-function apparatus 10 after the suction of the pump 142 is finished, the controller 130 performs the control in which the sheet-feed motor 76 is forwardly rotated to discharge the recording sheet. Thus, the recording sheet remaining in the multi-function apparatus 10 after the suction of the ink is finished can be reliably discharged to an outside of the multi-function apparatus 10.

<First Modification of Embodiment>

Figure 9:
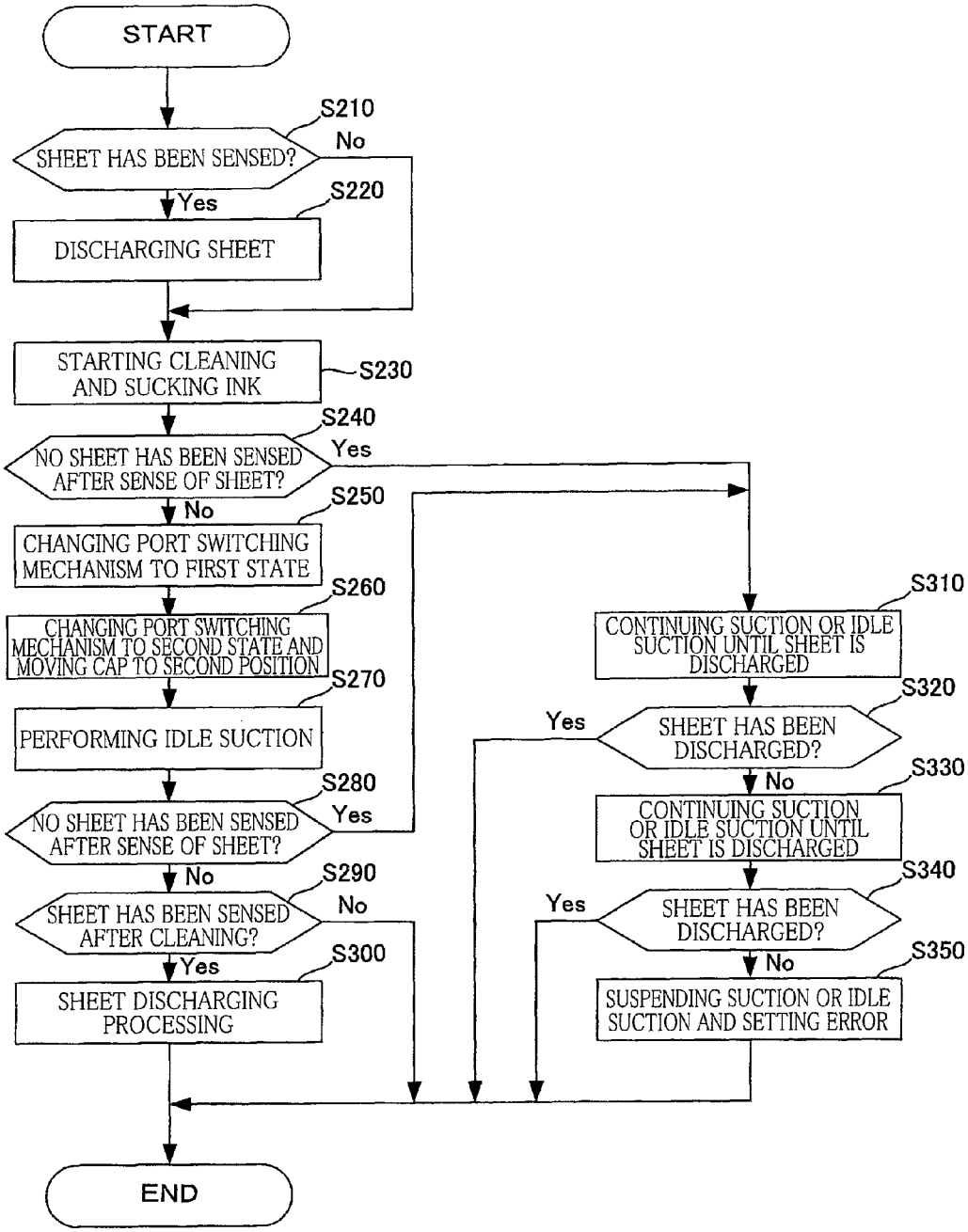
FIG. 9 is a flow-chart showing a modification of the procedure of the sheet-discharge control performed by the controller 130.

In the above-described embodiment, when the recording sheet detected by the register sensor 110 is discharged to the discharged-sheet holding portion 79, the position of the cap 46 is changed to the second position, but the present invention is not limited to this configuration of the multi-function apparatus 10. For example, the multi-function apparatus 10 may be configured such that the discharge of the recording sheet may be performed regardless of the position of the cap 46. There will be explained a sheet-discharge controlling processing in this configuration with reference to a flow-chart in FIG. 9. It is noted that an explanation of processings the same as those in the flow-chart of FIG. 8 will be omitted.

Processings S210 to S300 are respectively the same as the processings S10 to S100 in FIG. 8. Where the controller 130 has recognized in S240 or S280 that the optical sensor has become the low level after the high level during the suction of the ink in S230 or the idle suction in S270, the suction of the ink or the idle suction is continued in S310 to S350 until the recording sheet has been discharged or the controller 130 has judged that the sheet discharging operation is the sheet discharging error. It is noted that processings S310 to S350 are respectively the same as the processings S120 to S160 in FIG. 8.

In this first modification, even where the register sensor 110 has detected the recording sheet during the suction of the ink or the idle suction, the controller 130 performs a control in which the suction of the ink or the idle suction, that is, the driving of the first sheet-feed roller 60 and the second sheet-feed roller 62 is continued without changing the position of the cap 46, and the recording sheet is fed toward the downstream side in the sheet feeding direction. Thus, the recording sheet is speedily discharged to the discharged-sheet holding portion 79.

<Second Modification of Embodiment>

Figure 10:
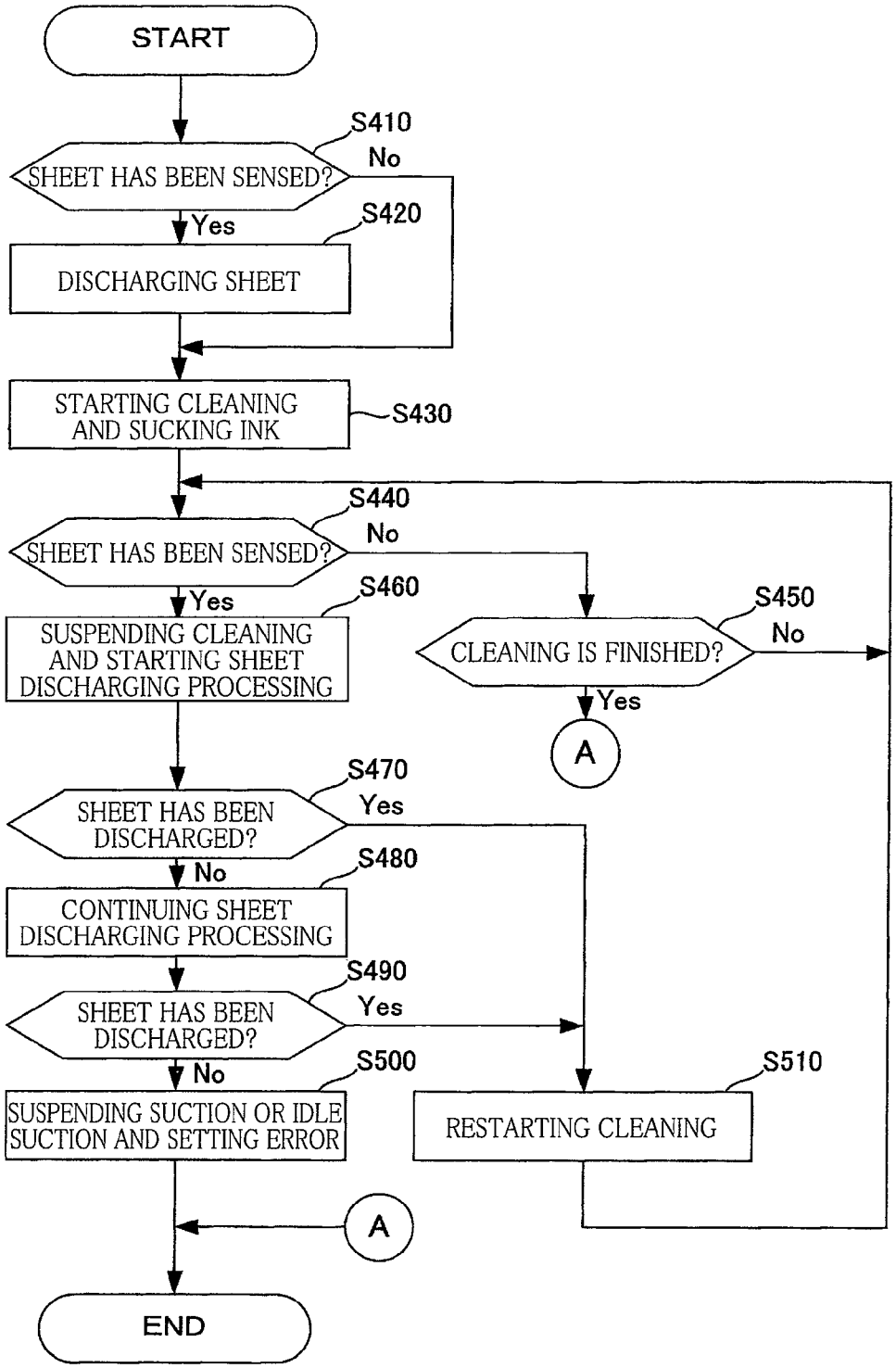
FIG. 10 is a flow-chart showing another modification of the procedure of the sheet-discharge control performed by the controller 130.

Further, the multi-function apparatus 10 may be configured such that the driving of the pump 142 is stopped, then the cap 46 is moved to the second position, and then the recording sheet is discharged when the register sensor 110 has sensed the recording sheet. There will be explained a sheet-discharge controlling processing in this configuration with reference to a flow-chart in FIG. 10. It is noted that an explanation of processings the same as those in the flow-chart of FIG. 8 will be omitted.

Processings S410 to S430 are respectively the same as the processings S10 to S30 in FIG. 8. Where the controller 130 has recognized that the optical sensor 111 has become the high level, that is, the leading end of the recording sheet has reached the register sensor 110, during the suction of the ink in S430 (S440: Yes), the controller 130 stops in S460 the cleaning by the maintenance unit 80 for the recording portion 24, then the cap 46 is moved to the second position, and then the sheet discharging operation is performed. Specifically, the controller 130 stops the driving of the sheet-feed motor 76 and thereby stops the driving of the pump 142. As a result, the suction of the ink is stopped. Then, the position of the cap 46 is changed to the second position. Then, the carriage 31 is slid to the image recording area. Then, the sheet-feed motor 76 is forwardly rotated, whereby the recording sheet is started to be fed toward the downstream side in the sheet feeding direction. In this time, even where the pump 142 is being driven, the ink is not sucked because the carriage 31 is located in the image recording area.

The processing of S440 is repeated until the cleaning is finished in S450 or the controller 130 has judged in S500 that the sheet discharging operation is the sheet discharging error. Processings S470 to S500 are respectively the same as the processings S130-S160 in FIG. 8. However, where the controller 130 has judged in S470 or S490 that the recording sheet has been discharged, the cleaning is restarted in S510 and repeated until the controller 130 has recognized that the optical sensor 111 has not become the high level (S440: No) and the cleaning is finished in S450, or the controller 130 has judged in S500 that the sheet discharging operation is the sheet discharging error. In this second modification, the recording sheet is discharged after the driving of the pump 142 is stopped and the position of the cap has been changed to the second position. Thus, the ink is not sucked, thereby preventing the wasteful ink consumption.

<Third Modification of Embodiment>

Figure 11:
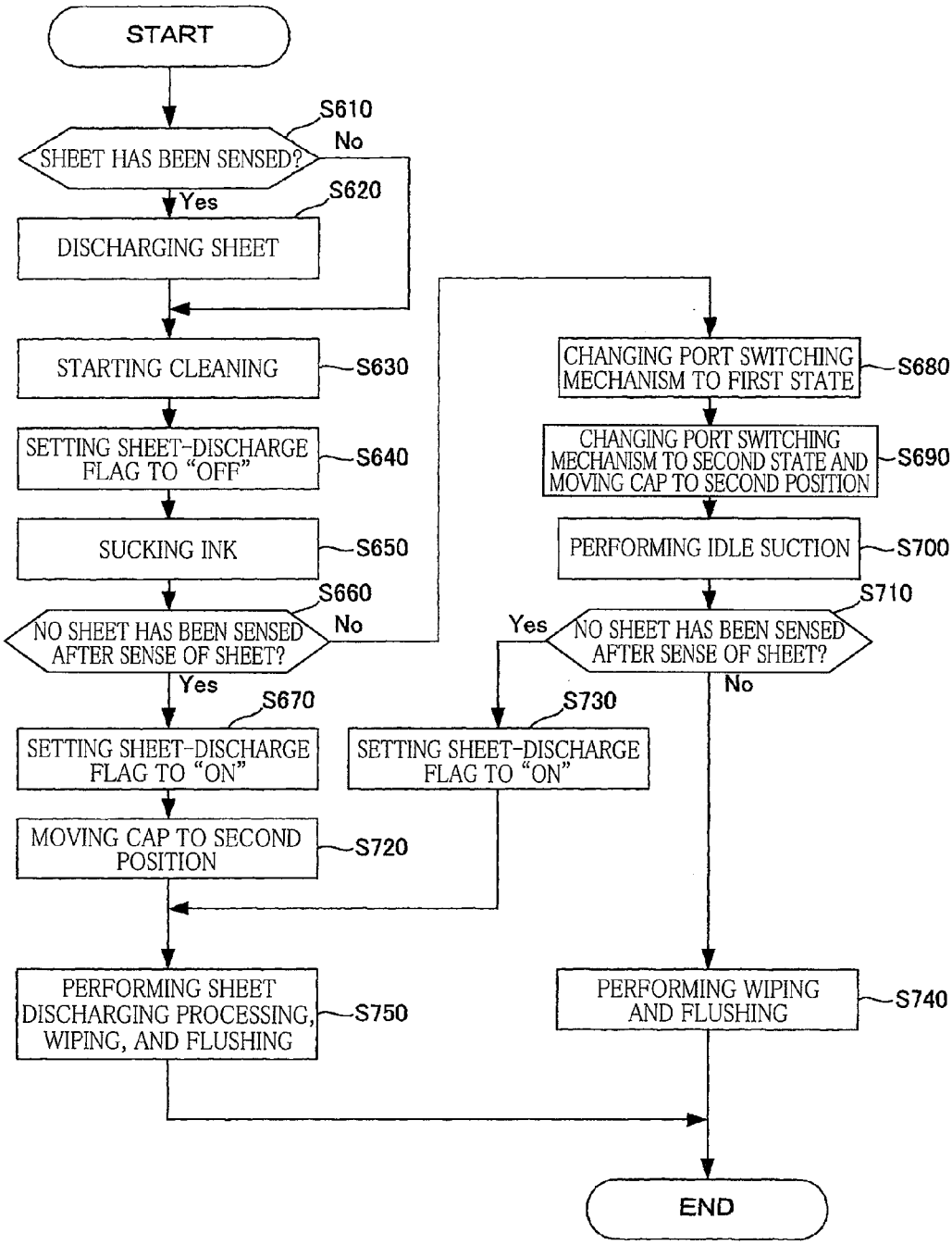
FIG. 11 is a flow-chart showing another modification of the procedure of the sheet-discharge control performed by the controller 130.

Further, the multi-function apparatus 10 may be configured such that the sheet discharging operation is performed when the linear encoder has sensed that the recording portion 24 is located at a position different from the retracted position. There will be explained a sheet-discharge controlling processing in this configuration with reference to a flow-chart in FIG. 11. In FIG. 11, it is assumed that when the linear encoder has sensed that the recording portion 24 is located at the position different from the retracted position, the wiping or the flushing is performed. This is because the wiper blade 56 used in the wiping protrudes when the recording head 30 is slid toward the image recording area, i.e., toward a position different from the retracted position, while the waste-ink tray 45 which faces the recording head 30 upon the flushing is disposed at an position opposed to the purging mechanism 44, i.e., at a position different from the retracted position as described above. Further, in this third modification, a sheet-discharge flag representing whether the recording sheet is to be discharged or not is set as a register provided on, e.g., the CPU 131 or a variable in the program. It is noted that an explanation of processings the same as those in the flow-chart of FIG. 8 will be omitted.

Processings of S610 and S620 are respectively the same as the processings S10 and S20 in FIG. 8. Then, the controller 130 starts in S630 the cleaning for the recording portion 24 and sets in S640 the sheet-discharge flag to "OFF" representing that the sheet is not discharged, and then, in S650, the ink is sucked from the nozzles and so on. Then, the controller 130 performs processings S660-S710 respectively the same as the S40-S80 in FIG. 8. However, where the controller 130 has recognized in S660 that the optical sensor 111 has become the low level after the high level (S660: Yes), the sheet-discharge flag is set in S670 to "ON" representing that the sheet is to be discharged, then the position of the cap 46 is changed in S720 to the second position, and then the controller 130 performs a processing of S750. Further, where the controller 130 has recognized in S710 that the optical sensor 111 has become the low level after the high level (S710: Yes), the controller 130 sets in S730 the sheet-discharge flag to "ON" and then performs the processing of S750.

In S750, the wiping and the flushing are performed. In this case, the linear encoder detects that the recording portion 24 is disposed at the position different from the retracted position by the wiping and the flushing. Where the linear encoder has detected that the recording portion 24 is disposed at the position different from the retracted position, the controller 130 performs in S750 the control in which the sheet-feed motor 76 is forwardly rotated, and the recording sheet sensed by the register sensor 110 is discharged to the discharged-sheet holding portion 79.

On the other hand, where the controller 130 has not recognized in S660 and S710 that the optical sensor 111 has become the low level after the high level (S660: No, S710: No) and the idle suction is finished, the wiping and the flushing are performed in S740.

In this third modification, when the recording portion 24 is disposed at the position different from the retracted position, and the wiping or the flushing is being performed, the sheet-feed motor 76 is forwardly rotated and the pump 142 is driven. Thus, the ink is not sucked from the nozzles and so on, thereby preventing the wasteful ink consumption.

What is claimed is:

1. An image recording apparatus comprising:

a sheet-feed mechanism configured to perform a feeding operation in which the sheet-feed mechanism feeds a sheet along a sheet feeding path;

a sheet-detect portion configured to detect a presence of the sheet at a specific position on the sheet feeding path;

an image recording portion having a nozzle face in which nozzles are formed and configured to record an image on the sheet fed through the sheet feeding path by ejecting ink droplets through the nozzles;

a cap configured to be movable between a first position at which the cap covers the nozzle face and a second position at which the cap is distant from the nozzle face;

a sucking mechanism configured to perform a sucking operation in which the sucking mechanism sucks air or liquid from an inside of the cap in a state in which the sucking mechanism is communicated with the cap;

a drive source configured to generate a drive force for driving the sheet-feed mechanism and the sucking mechanism;

a drive-force transmitting mechanism configured to transmit one of a forward-direction drive force and a reverse-direction drive force generated by the drive source to the sheet-feed mechanism and the sucking mechanism respectively as a drive force for the feeding operation in one direction by the sheet-feed mechanism and as a drive force for the sucking operation of the sucking mechanism, and configured to transmit the other of the forward-direction drive force and the reverse-direction drive force to the sheet-feed mechanism as a drive force for the feeding operation in another direction by the sheet-feed mechanism; and a controller configured to control the drive source such that the sheet is fed in the one direction and discharged without the feeding of the sheet in said other direction by the sheet-feed mechanism after the sheet-detect portion has detected the sheet during the operation of the sucking mechanism.

2. The image recording apparatus according to claim 1, wherein the controller is configured to control the drive source such that the sheet-feed mechanism performs the feeding operation in the one direction and the sucking mechanism performs the sucking operation.

3. The image recording apparatus according to claim 1, wherein the sheet-detect portion is configured to detect the presence of the sheet at the specific position which is located on an upstream side of a position on the sheet feeding path which faces to the image recording portion, in a direction in which the sheet is fed, and wherein the controller is configured to control the drive source such that the sheet-feed mechanism performs the feeding operation in the one direction and the sucking mechanism performs the sucking operation after the sheet-detect portion has detected that the sheet is present at the specific position and then detected that the detected sheet has been fed away from the specific position.

4. The image recording apparatus according to claim 1, wherein the controller is configured to control the drive source such that the sheet-feed mechanism continues to perform the feeding operation in the one direction and the sucking mechanism continues to perform the sucking operation after the detection of the sheet by the sheet-detect portion.

5. The image recording apparatus according to claim 1, wherein the controller is configured to control the drive source such that the sheet-feed mechanism performs the feeding operation in the one direction and the sucking mechanism performs the sucking operation after the sheet-detect portion has detected the sheet and then the cap has been moved to the second position.

6. The image recording apparatus according to claim 1, further comprising a cap-position detecting portion configured to detect a position of the cap, wherein the controller is configured to control the drive source such that the sheet-feed mechanism performs the feeding operation in the one direction and the sucking mechanism performs the sucking operation where the cap-position detecting portion has detected that the cap is located at the second position.

7. The image recording apparatus according to claim 1, wherein the controller is configured to control the drive source such that the sucking operation of the sucking mechanism is stopped after the sheet-detect portion has detected the sheet, and then control the drive source such that the sheet-feed mechanism performs the feeding operation in the one direction and the sucking mechanism performs the sucking operation after the cap has been moved to the second position.

8. The image recording apparatus according to claim 1, further comprising a sheet-discharge detecting portion configured to detect whether the sheet has been discharged from the image recording apparatus or not, wherein the controller is configured to control the drive source such that the feeding operation of the sheet-feed mechanism in the one direction and the sucking operation of the sucking mechanism are continued until the suction of the air or the liquid in the cap is completed, where the sheet-detect portion has detected the sheet, and wherein the controller is configured to control the drive source such that the sheet-feed mechanism performs the feeding operation in the one direction and the sucking mechanism performs the sucking operation on a condition that the sheet-discharge detecting portion has not detected that the sheet has been discharged from the image recording apparatus, after the completion of the sucking operation of the sucking mechanism.

9. The image recording apparatus according to claim 1, further comprising a recording-portion-position detecting portion configured to detect a position of the image recording portion in a direction perpendicular to a sheet feeding direction in which the sheet is fed, wherein the image recording portion is configured to be reciprocated in the direction perpendicular to the sheet feeding direction, wherein the cap is provided at a retracted position located at an area which is in a range of the reciprocation of the image recording portion and through which the fed sheet does not pass, and wherein the controller is configured to perform the control in which the sheet is discharged on condition that the recording-portion-position detecting portion has detected that the image recording portion is located at a position different from the retracted position.

10. The image recording apparatus according to claim 1, further comprising a sheet placed portion on which is placed the sheet for image recording by the image recording portion, wherein the one direction in which the sheet is fed by the sheet-feed mechanism coincides with a direction in which the sheet fed from the sheet placed portion is fed toward the image recording portion.

11. The image recording apparatus according to claim 1, further comprising a discharged-sheet placed portion onto which is discharged and placed the sheet on which the image has been recorded by the image recording portion, wherein the one direction in which the sheet is fed by the sheet-feed mechanism coincides with a direction in which the sheet on which the image has been recorded by the image recording portion is fed toward the discharged-sheet placed portion.

12. The image recording apparatus according to claim 10, wherein the sheet placed portion includes an inside sheet placed portion disposed on an inside of the image recording apparatus and an outside sheet placed portion disposed on an outside of the image recording apparatus, and wherein the sheet-detect portion is configured to detect that the sheet has been fed to a position located on a downstream side of a meeting position at which a path through which the sheet is fed from the inside sheet placed portion to the image recording portion and a path through which the sheet is fed from the outside sheet placed portion to the image recording portion meet each other.

13. The image recording apparatus according to claim 1, wherein the sucking mechanism includes (i) a changing portion configured to change a state of the sucking mechanism between a communicating state in which the sucking mechanism is communicated with the cap and a non-communicating state in which the sucking mechanism is not communicated with the cap, and (ii) a sucking portion configured to suck the air or the liquid in a state in which the sucking portion is communicated with the cap, and wherein the drive-force transmitting mechanism is configured to transmit the one of the forward-direction drive force and the reverse-direction drive force as the drive force for the feeding operation in the one direction by the sheet-feed mechanism and as a drive force for an operation of the sucking portion of the sucking mechanism, and configured to transmit the other of the forward-direction drive force and the reverse-direction drive force as the drive force for the feeding of the sheet in said other direction by the sheet-feed mechanism and as a drive force for an operation of the changing portion of the sucking mechanism.

* * * * *